US005968216A

United States Patent [19]

Powell et al.

[11] Patent Number: 5,968,216

[45] Date of Patent: Oct. 19, 1999

[54] SECURITY VENT

[76] Inventors: Robert A. Powell, 39 Elmwood Ct., Frankfort, Ky. 40601; Richard W. Stephens, 572 E. 80 Dr., Columbia, Ky. 42728

[21] Appl. No.: 09/065,004

[22] Filed: Apr. 23, 1998

Related U.S. Application Data

[63] Continuation-in-part of application No. 09/031,948, Feb. 27, 1998.

[51] Int. Cl.[6] ..... F24F 13/28

[52] U.S. Cl. ..... 55/493; 55/506

[58] Field of Search ..... 55/493, 502, 504; 109/1 V; 454/48, 254, 271, 275, 276

[56] References Cited

U.S. PATENT DOCUMENTS

| | | | |
|---|---|---|---|
| 2,575,499 | 11/1951 | Manow . | |
| 3,204,392 | 9/1965 | Schwab . | |
| 3,301,168 | 1/1967 | Schindler et al. . | |
| 3,740,934 | 6/1973 | Schuler . | |
| 4,171,210 | 10/1979 | Miller | 55/493 X |
| 4,365,541 | 12/1982 | Marques et al. | 55/504 X |
| 4,472,184 | 9/1984 | Neumann et al. | 55/493 X |
| 5,421,862 | 6/1995 | Davis . | |

FOREIGN PATENT DOCUMENTS

| | | | |
|---|---|---|---|
| 2 085 195 | 4/1981 | United Kingdom | 55/504 |

*Primary Examiner*—Harold Joyce

*Attorney, Agent, or Firm*—Killworth, Gottman, Hagan & Schaeff LLP

[57] ABSTRACT

A security vent is mountable to an existing air duct inlet opening and includes a housing assembly having a mounting frame fixedly secured to an inlet end of an air duct and a housing wall fixedly secured to the mounting frame by at least one side wall portion. The housing wall includes a front face being in spaced relation to the mounting frame and includes a perforated front face thereof. The mounting frame includes an opening therethrough which cooperates with the perforated front face of the housing wall permit flow communication of the air duct through the security vent. The housing wall cooperates with the mounting frame to define a filter-receiving region therebetween. A door is hingedly attached to an open side wall and is moveable between an open position and a closed position. A latch assembly is fixedly attached to the door and is moveable between a locked position and an unlocked position. The latch assembly is receivable by a latch-receiving aperture in the mounting frame to lock the door in the closed position. The filter-receiving region communicates through the open side wall to receive a filter therein.

14 Claims, 6 Drawing Sheets

SECURITY VENT

CROSS-REFERENCE TO RELATED APPLICATIONS

The present application is a continuation-in-part of, and claims priority from, our pending U.S. patent application Ser. No. 09/031,948, filed Feb. 27, 1998, entitled "Security Vent", said Application being incorporated herein by reference.

BACKGROUND OF THE INVENTION

1. Technical Field of the Invention

The present invention relates to air vents for use in providing ventilation to and from an enclosed region within a building, such as, for example, a room, closet, office, restroom or the like. More particularly, the present invention relates to an air vent for use in providing ventilation to and from an enclosed region within a building, such as, for example, a room, closet, office, restroom or the like, wherein the air vent prevents access to an area exterior to the enclosed region therethrough.

2. Description of the Related Art

Office buildings, commercial establishments, industrial plants, educational institutions, residential homes and the like typically include a plurality of enclosed regions, such as, for example, rooms, closets, offices, restrooms or the like, defined therein for occupancy by office personnel, customers, employees, students, residents or the like. The building and the enclosed regions each require ventilation and exchange of the air contained therein with the air exterior to the building existing in the surrounding ambient. Typically, return air, that is, air being removed from the enclosed regions and expelled from the building into the ambient, is pumped from within the enclosed regions and out of the building by a heating, ventilating and air-conditioning ("HVAC") system which typically comprises a series of large fans and a network of inter-connected air ducts connecting the respective enclosed regions of the building to the exterior of the building.

Filtering of the return air to remove air-born particles, such as, for example, dust, debris, smoke and the like, is typically performed at the outlet end of the HVAC system just prior to expelling the exhaust air therefrom. Further, the return air is typically not filtered at the respective inlet ends of the return air ducts, which respectively communicate with the numerous enclosed regions. Because the return air is not filtered prior to entry thereof into the return air duct network, air-born material is permitted to accumulate within the air duct network at various locations throughout, thereby increasing the risk of a so-called "duct fires" therein, as well as decreasing the overall operating efficiency of the HVAC system. It is therefore desirable to provide an air vent for use with an HVAC system of a building. It is also desirable to provide an air vent for use with an HVAC system of a building, wherein the air vent removably receives a filter therein for use in removing air-born particles therefrom. It is furthermore desirable to provide an air vent for use with an HVAC system of a building, wherein the air vent removably receives a filter therein for use in removing air-born particles therefrom, and wherein the air vent is provided at an inlet end of a return air duct.

Similarly, penal institutions, mental hospitals and other secure facilities require ventilation and exchange of the air contained therein, and of the air contained within the cells, rooms and other confined areas therein, with the air exterior thereto present in the surrounding ambient. However, unlike a non-secure facility, a secure facility must not provide an opportunity for a confined individual to escape therefrom, such as, for example, through the HVAC system, or provide an opportunity for the confined individual to insert an article of contraband therein, such as, for example, a weapon, drug paraphernalia or the like. Thus, the respective inlet ends of the return air ducts are oftentimes integrally formed with the wall portions which define the respective enclosed regions. A removable air vent is not typically provided at the inlet ends of the return air ducts connected to the wall portions of a secure facility, as this may provide an opportunity for a confined individual to remove same and escape from the secure facility or to insert contraband therein. Rather, the wall portion is typically provided with a security screen having a plurality of apertures therethrough through which air from the enclosed region may pass into the return air duct network.

Access to the return air ducts from the enclosed region is prevented by the security screens, which, as stated, are integrally-formed with the respective wall portions defining the enclosed regions. Thus, a filter cannot be positioned inwardly adjacent the security screen to remove air-born material from the return air prior to entry into the return air duct network, as maintenance personnel would not be able to remove and/or clean same from accumulated air-born material, dirt or debris.

It has been further observed that air-born material instead accumulates on the security screens, which are neither accessible nor replaceable, thereby decreasing volumetric flow of air from the enclosed regions into the return air duct, decreasing overall ventilation efficiency, decreasing the quality of air being removed from the enclosed regions, and increasing the likelihood of so-called "duct fires" due to ignition of the accumulated air-born material. It is therefore desirable to provide an air vent for use with an HVAC system of a building, wherein the air vent provides secure access to an air duct connected thereto.

For example, Applicants' pending application referred-to hereinabove and incorporated herein by reference teaches an air vent for use with an HVAC system of a building, wherein the air vent is installable most likely during construction of a new building. However, it is furthermore desirable to provide an air vent for use with an HVAC system of a building, wherein the air vent may be installed in the building after the building has been constructed and with a minimum amount of modification to any existing air ducts, vents or the like.

SUMMARY OF THE INVENTION

The present invention is for a security vent for use in a secure facility, such as, for example, a penal institution, a mental hospital or the like, or for use in a non-secure facility, such as, for example, an office building, commercial establishment, industrial plant, educational institution, residential home or the like. More particularly, a security vent according to a preferred embodiment of the present invention is mountable to an existing air duct inlet opening and includes a housing assembly having a mounting frame fixedly secured to an inlet end of an air duct and a housing wall fixedly secured to the mounting frame by at least one side wall portion. The housing wall includes a front face being in spaced relation to the mounting frame and includes a perforated front face thereof. The mounting frame includes an opening therethrough which cooperates with the perforated front face of the housing wall permit flow communication of the air duct through the security vent. The housing wall cooperates with the mounting frame to define a filter-receiving region therebetween. A door is hingedly attached to an open side wall and is moveable between an open position and a closed position. A latch assembly is fixedly attached to the door and is moveable between a locked position and an unlocked position. The latch assembly is receivable by a latch-receiving aperture in the mounting frame to lock the door in the closed position. The filter-receiving region communicates through the open side wall to receive a filter therein.

It is an object of the present invention to provide an air vent for use with an HVAC system of a building.

It is another object of the present invention to provide an air vent for use with an HVAC system of a building, wherein the air vent removably receives a filter therein for use in removing air-born particles therefrom.

It is yet another object of the present invention to provide an air vent for use with an HVAC system of a building, wherein the air vent removably receives a filter therein for use in removing air-born particles therefrom, and wherein the air vent is provided at an inlet end of a return air duct.

It is still another object of the present invention to provide an air vent for use with an HVAC system of a building, wherein the air vent provides secure access to an air duct connected thereto.

It is yet another object of the present invention to provide an air vent for use with an HVAC system of a building, wherein the air vent may be installed in the building after the building has been constructed and with a minimum amount of modification to any existing air ducts, vents or the like.

These and other objects, features and advantages of the present invention will become apparent to those skilled in the art upon reading the ensuing detailed description in conjunction with the drawings and appended claims.

A security vent according to a preferred embodiment of the present invention includes a housing assembly, the housing assembly including a mounting frame and a housing wall having at least one side wall portion connecting the housing wall to the mounting frame, the mounting frame having an opening therethrough, the at least one side wall portion defining an open side thereof, the housing wall having a front face portion thereof being in spaced relation to the mounting frame and cooperating with the at least one side wall portion to define a filter-receiving region therebetween, the housing wall front face having at least one opening therethrough; a door hingedly attached to the open side of the housing wall, the door being moveable between an open position and a closed position, wherein the filter-receiving region is in communication with a region exterior to the housing wall when the door is in the open position; and, a latch assembly mounted to the door, the latch assembly being moveable between a locked position and an unlocked position, the latch assembly being received by a latch-receiving aperture provided in the mounting frame when the door is in the closed position.

BRIEF DESCRIPTION OF THE DRAWINGS

A better understanding of the present invention will be had upon reference to the following description in conjunction with the accompanying drawings in which like numerals refer to like parts, and wherein.

DETAILED DESCRIPTION OF THE PREFERRED EMBODIMENTS

Figure 1:
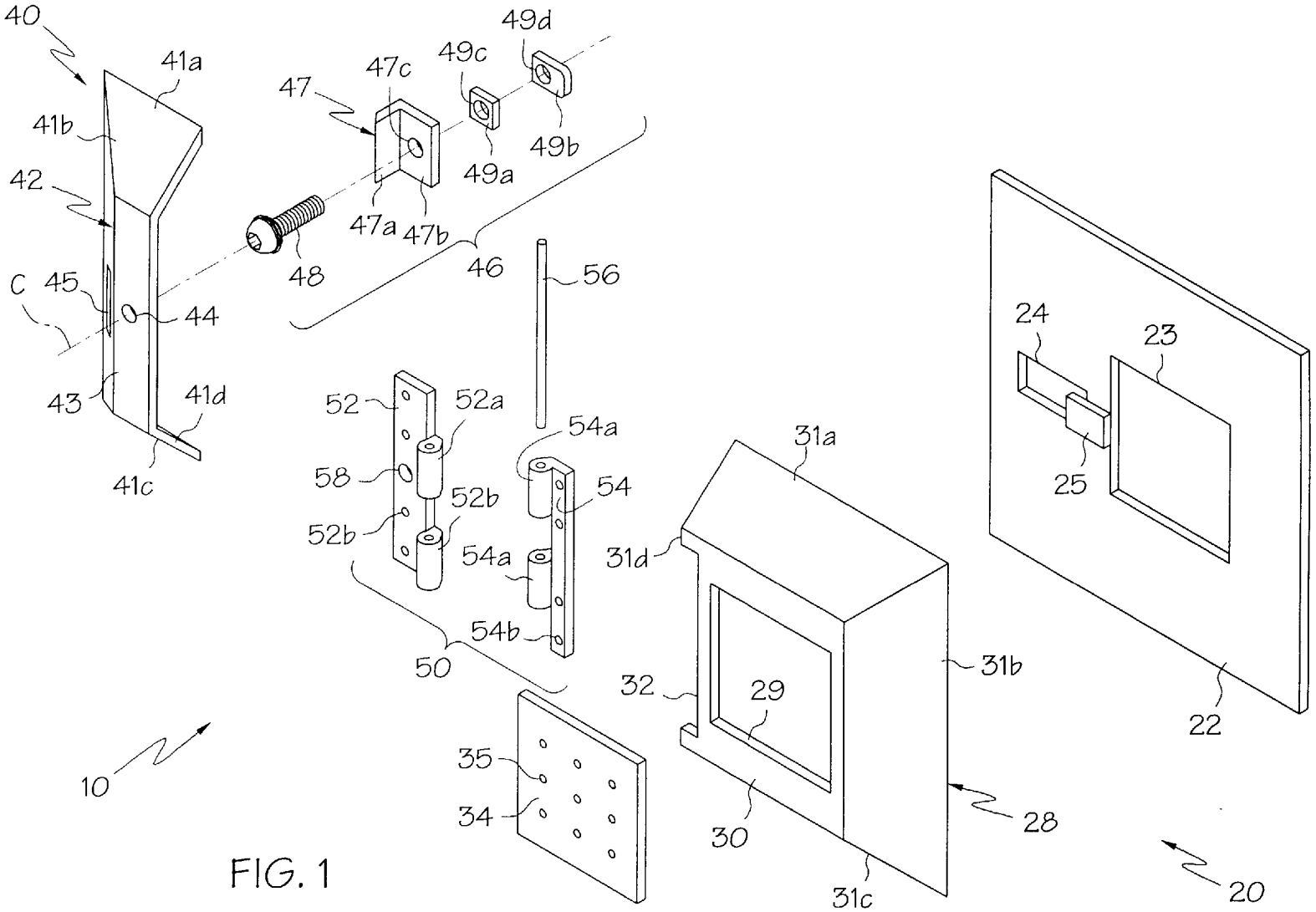
FIG. 1 is an exploded perspective view of a security vent according to a preferred embodiment of the present invention.
Figure 2:
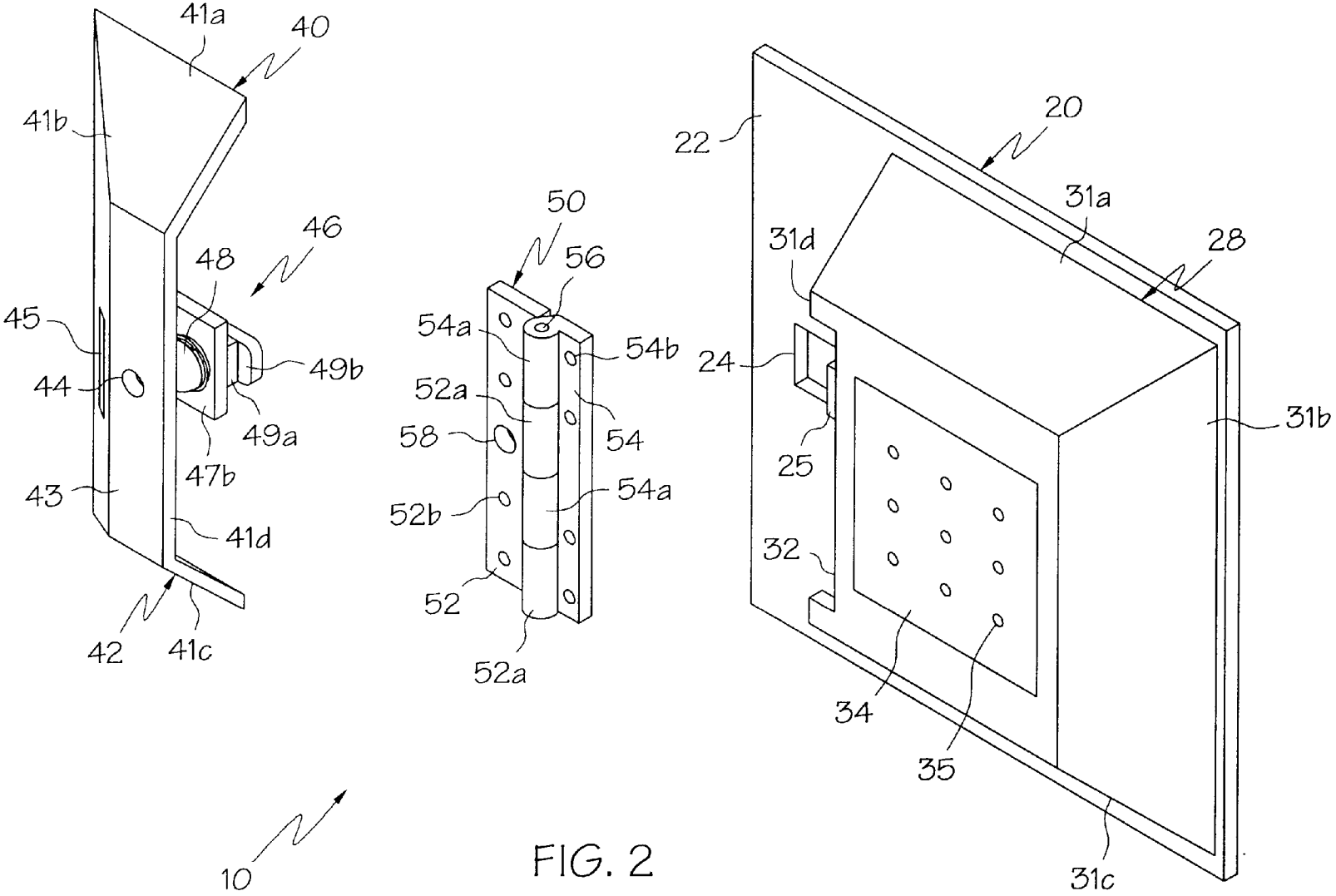
FIG. 2 is an exploded perspective view of the security vent of FIG. 1.
Figure 3:
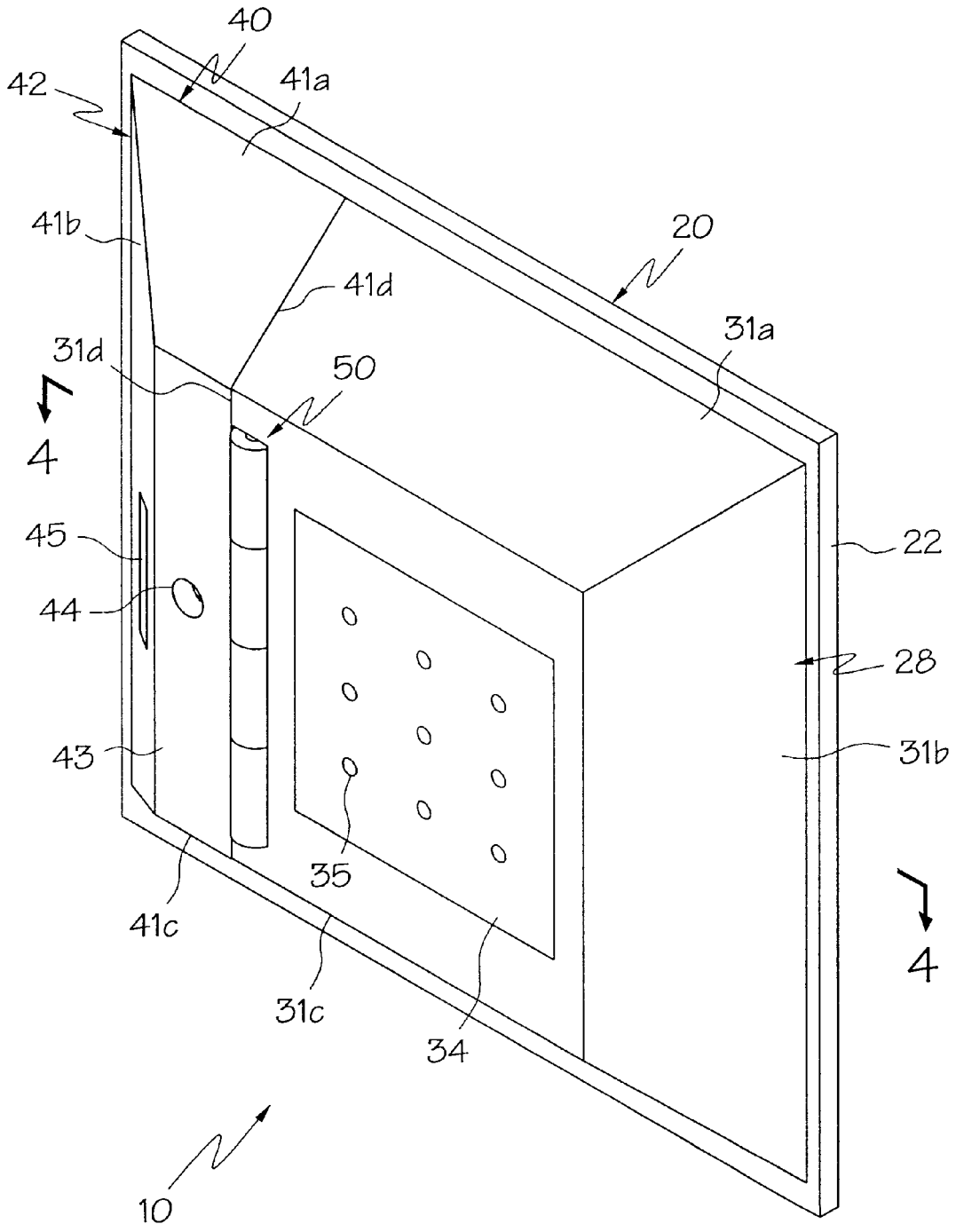
FIG. 3 is a perspective view of the security vent of FIG. 1, shown fully assembled and in a "closed" position.

With reference to FIGS. 1–3, a security vent 10 according to a preferred embodiment of the present invention includes a housing assembly 20 and a door assembly 40 hingedly connected to the housing assembly 20 by a hinge 50. The housing assembly 20 and the door assembly 40 are each preferably constructed from malleable hot-rolled steel which is sized, shaped and oriented as described hereinbelow. However, any suitable material being respectively formable into a similar size, shape and orientation thereof may be substituted in place thereof without departing from either the spirit or the scope of the present invention.

The hinge 50 is preferably a continuous hinge 50 having a door bracket 52, a housing bracket 54 and a pin 56 frictionally receivable by engageable pin-receiving portions 52*a*, 54*a* of the brackets 52, 54, respectively. A plurality of weld holes 52*b*, 54*b* are provided through each of the brackets 52, 54, respectively, to permit welded attachment of the brackets 52, 54 to the door assembly 40 and the housing assembly 20, respectively. A bracket key hole 58 is provided through the door bracket 52 near a midpoint thereof. Any suitable hinge known in the art may be substituted in place of the hinge 50 provided herein without departing from either the spirit or the scope of the present invention.

The housing assembly 20 includes a mounting frame 22, a beveled housing wall 28 and a perforated housing face 32. The mounting frame 22 is shaped substantially like a picture frame and includes an opening 23 therethrough sized to fit over an inlet opening of a return air duct provided in a wall of a building. A latch-receiving aperture 24 is provided through the mounting frame 22 near a vertical midpoint thereof and offset from a horizontal midpoint between the opening 23 and a left side thereof. A latch stop 25 is fixedly secured, such as, for example, by welding to the mounting frame 22 such that a portion of the latch stop 25 projects over the aperture 24 a preselected distance towards the left side of the mounting frame 22.

The beveled housing wall 28 is shaped substantially like a beveled picture frame and includes an opening 29 through a front face 30 thereof sized to receive the perforated housing face 34 therein in a flush configuration. The housing face 34 is preferably fixedly secured, such as, for example, by welding, coextensively within the opening 29 to prevent removal of the housing face 34 therefrom.

The front face 30 is surrounded on three sides thereof by rearwardly- and outwardly-beveled sides 31*a*, 31*b*, 31*c*, each of which is fixedly secured, such as, for example, by welding, to the mounting frame 22 around three sides of the mounting frame opening 23 such that the mounting frame opening 23 and the beveled wall opening 29 are substantially aligned. The housing face 34 includes a plurality of orifices 35 therethrough. A left side 31*d* of the housing wall 28 includes a straight edge having a cut-out portion 32 therein which is sized to receive the engaged hinge pin-receiving portions 52*a,* 54*a*. The mounting frame 22 and the beveled housing wall 28 cooperate to define a filter-receiving region 62 (FIG. 4) therebetween.

The door assembly 40 includes a beveled door 42 and a latch assembly 46 fixedly secured, such as, for example, by welding, to an inside surface of the door 42, and projecting rearwardly from the door 42 towards the mounting frame 22. The door 42 includes a front face 43 surrounded on three sides thereof by rearwardly-and outwardly-beveled sides 41*a,* 41*b,* 42*c*. A right side 41*d* of the door 42 includes a straight edge which is sized and shaped to abut the left side edge 31*d* of the housing wall 28, thereby providing a uniform, continuous appearance when the door 42 is connected to the housing wall 28 and is oriented in a "closed" position, such as shown in FIG. 3. A key hole 44 is provided through the front face 43 near a vertical midpoint thereof and a vertical slot 45 is provided through the second beveled side 41*b*.

Figure 6:
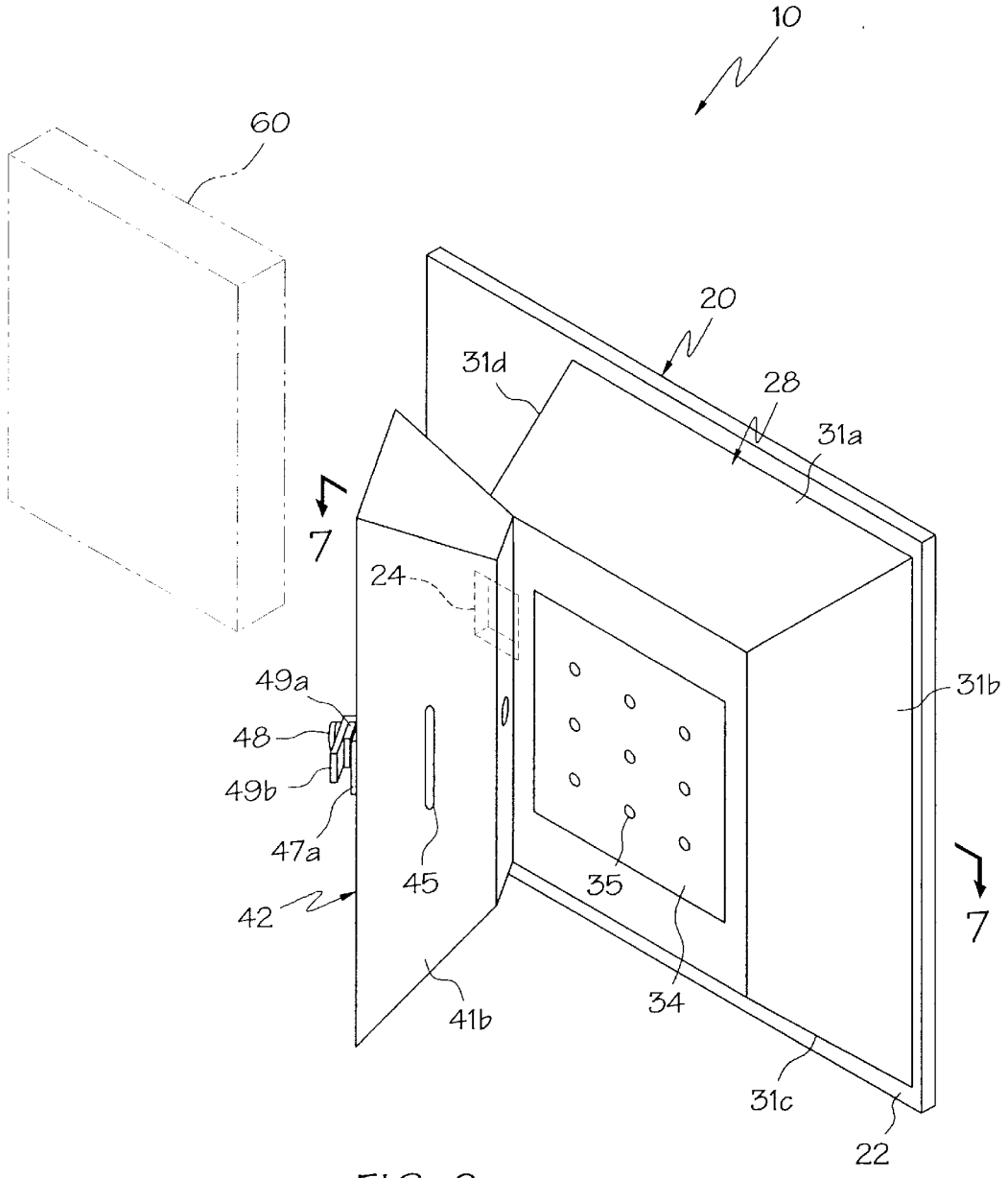
FIG. 6 is a perspective view of the security vent of FIG. 1, shown in an "open" position and shown with an air filter in spaced relation thereto; and, FIG. 7 is a section view of the security vent of FIG. 3, shown along section line 7—7 of FIG. 6 and shown with an air filter inserted therein.

The door assembly 40 is hingedly connected to the housing assembly 20 by the hinge 50 and is moveable between the "closed" position, such as shown in FIG. 3, and an "open" position, such as shown in FIG. 6. More particularly, the door bracket 52 is fixedly secured, such as, for example, by welding, to a rearwardly-facing surface of the door front face 43 such that the bracket key hole 58 is aligned with the key hole 44. The housing bracket 54 is fixedly secured, such as, for example, by welding, to a rearwardly-facing surface of the housing wall front face 30. The weld holes 52*a,* 54*a* permit secured welded attachment of the brackets 52, 54 to the door 42 and to the housing wall 28, respectively. The respective pin-receiving portions 52*a,* 54*a* are engaged with one another and the pin 56 is slidingly received therethrough to hingedly connect the brackets 52, 54 to one another. The pin 56 is received by the pin-receiving portions 52*a,* 54*a* to permit relative rotational hand movement of the brackets 52, 54, but with sufficient friction to prevent removal of the pin 56 therefrom without significant force or without special tools. Alternatively, the pin 56 may be tack-welded to a portion of either of the pin-receiving portions 52*a,* 54*a* to prevent removal of the pin 56 therefrom altogether.

Figure 4:
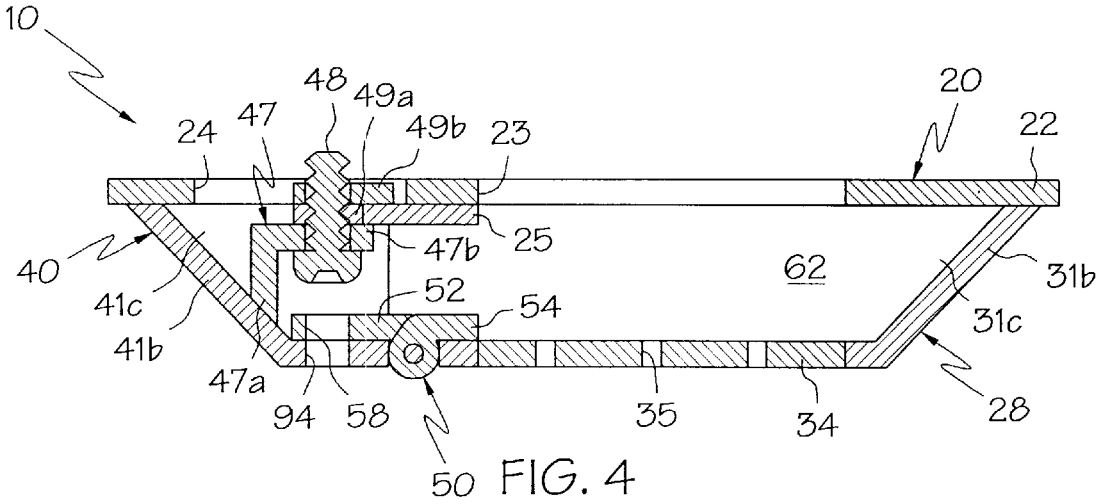
FIG. 4 is a section view of the security vent of FIG. 3, shown along section line 4—4 of FIG. 3.
Figure 5A:
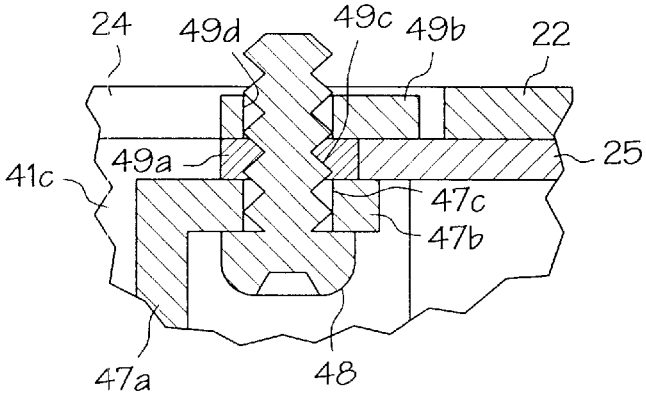
FIG. 5*a* is a section view of a latch assembly of the security vent of FIG. 4, shown in a "locked" position.
Figure 5B:
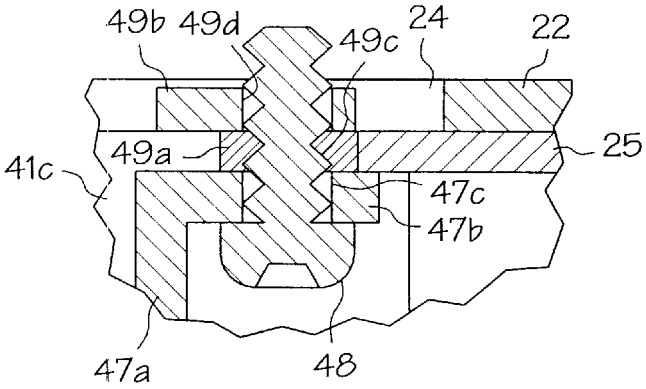
FIG. 5*b* is a section view of the latch assembly of FIG. 4, shown in an "unlocked" position.

With additional reference to FIGS. 4–5*b,* the latch assembly 46 includes an angled mount bracket 47 having a forwardly-projecting portion 47*a* fixedly secured, such as, for example, by welding, to the rearwardly-facing surface of the door 42 within the slot 45. A transverse portion 47*b* of the mount bracket 47 includes a bore 47*c* sized to slidingly receive a tightening bolt 48 therethrough. A lock block 49*a* and a latch 49*b* are fixedly secured to one another, such as, for example, by welding, to form a latch weldment rotatably moveable between a "locked" position, such as shown in FIG. 5*a,* and an "unlocked" position, such as shown in FIG. 5*b*. The lock block 49*a* includes a threaded hole 49*c* to engage the tightening bolt 48; the latch 49*b* includes a bore 49*d* sized to slidingly receive the tightening bolt 48. The block hole 49*c* and the latch bore 49*d* are coaxial. The threads of the lock block 49*a* and of the tightening bolt 48 are designed such that relative rotation therebetween requires a large torque. As such, the tightening bolt 48 cannot be threadingly removed from the lock block 49*a* by hand rotation thereof and rotation of the tightening bolt 48 causes equivalent rotation of the latch weldment unless the latch weldment is held firmly in a stationary position, such as, for example, by a wrench or pliers.

More particularly, the tightening bolt 48 is threadingly engaged with the threaded hole 49*c* of the lock block 49*a* such that the transverse portion 47*b* of the mount bracket 47 is positioned between a head portion of the tightening bolt 48 and the mount block 49*a,* and such that the lock block 49*a* is positioned between the transverse portion 47*b* of the mount bracket 47 and the latch 49*b*. The latch assembly 46 is fixedly secured to the door 42 such that the tightening bolt 48 is rotatable about an axis "C" which is coincident with an axis of the door key hole 44. The transverse portion bore 47*c,* the mount block threaded hole 49*c* and the latch bore 49*d* are each coaxial with axis "C". The forwardly-projecting portion 47*a* of the mount bracket 47 is translationally positioned within the slot 45 such that the tightening bolt head portion is spaced rearwardly from the door key hole 44 by a distance sufficient to prevent access to the latch assembly 46 without a properly-sized key. The head portion of the tightening bolt 48 is provided with a hexagonal or other similarly-shaped recess, which requires a key having a similar size, shape and geometry to rotate same. Accordingly, unwanted rotation of the latch 49*b* into the "unlocked" position, without the key, is prevented thereby.

The security vent 10 is mountable to an existing wall defining an enclosed region of a building adjacent an inlet end of a return air duct disposed therebehind which is connected to a heating, ventilating and air-conditioning system to remove air from the enclosed region thereby. For example, where an existing inlet opening provided in an inmate cell of a penal institution comprises a perforated metal plate integrally-formed in a concrete cell wall, an opening is cut through the perforated metal plate by any suitable process, such as, for example, by a cutting torch. A rearwardly-facing surface of the mounting frame 22 is fixedly secured, such as, for example, by welding, to the existing metal plate such that the mounting frame opening 23 and the housing wall opening 29 are substantially aligned with the opening cut through the existing metal plate. A plurality of holes, slots or grooves may be provided through the mounting frame 22 to securely affix the mounting frame 22 to the existing metal plate. Alternatively, the mounting frame be affixed to the metal plate by any suitable, conventional means, such as, for example, by lock bolts or the like.

Figure 7:
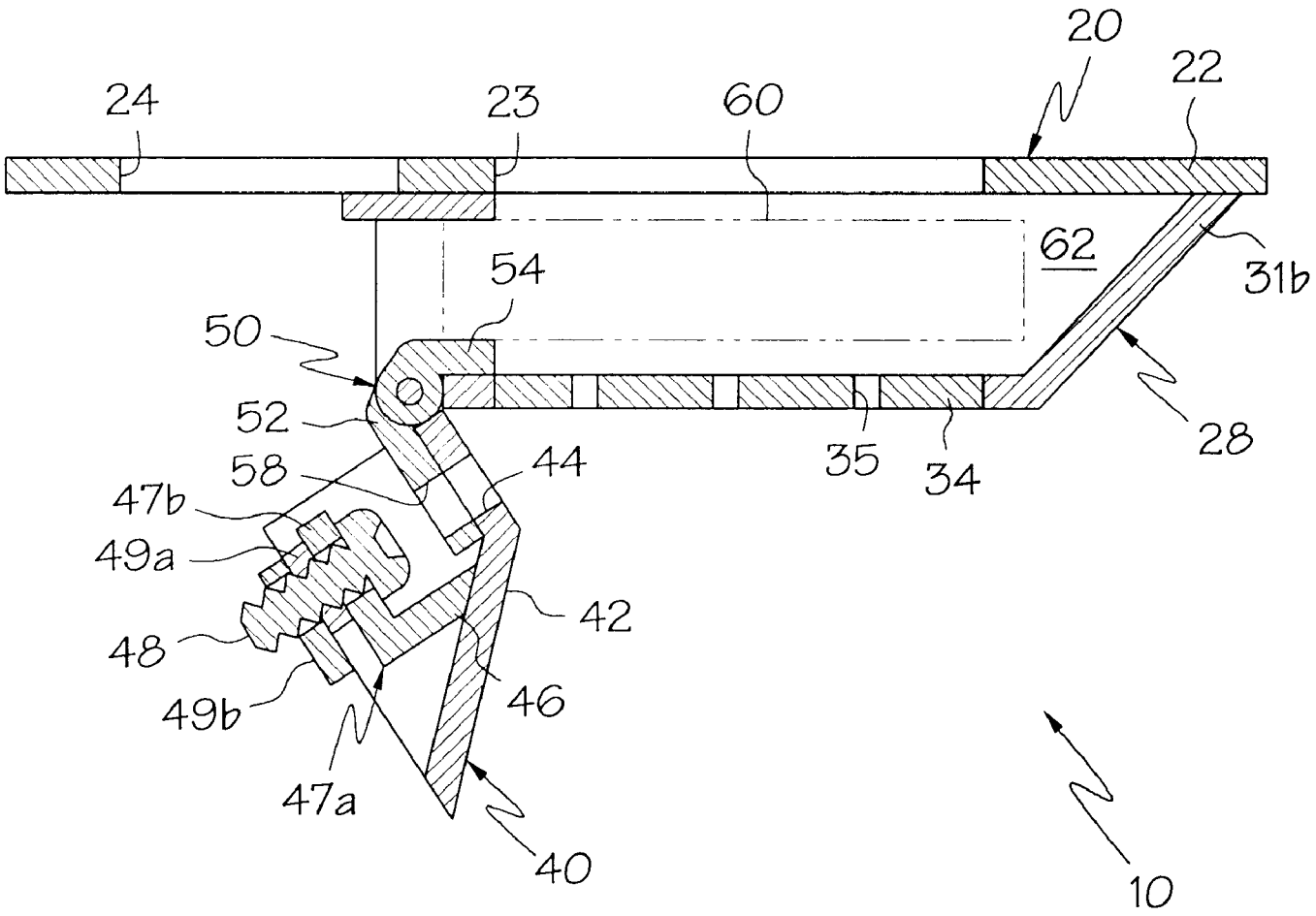

With additional reference to FIGS. 6 and 7, the filter-receiving region 62 is accessible through the left side of the security vent 10 by unlocking the latch 49*b* as described hereinbelow and pivoting the door assembly 40 about the hinge 50 into the "open" position. A filter 60, preferably constructed from fiberglass or the like, is slidingly received within the filter-receiving region 62 and is sized to be held firmly therein during operation. The mounting frame opening 23, the filter 60 and the housing face orifices 35 permit air to flow therethrough into the air duct therebehind with only nominal static pressure being developed within the air duct behind the filter 60.

Once the filter 60 has been inserted into the filter-receiving region 62, the door assembly 40 is pivoted into the "closed" position, wherein the latch 49*b* is received by the aperture 24 rearward of the latch stop 25. The tightening bolt 48 is then rotated in a clockwise direction which causes the latch 49*b* to rotate clockwise due to the tight threaded fit between the tightening bolt 48 and the lock block 49*a*. Rotation of the tightening bolt 48 (and the latch 49*b*) continues until the latch 49*b* is seated behind the latch stop 25 in the "locked" position, at which point a first side edge of the latch 49*b* abuts an upwardly-facing edge of the aperture 24, thereby preventing further rotation of the latch 49*b*.

Additional rotation of the tightening bolt 48, however, further threads the lock block 49*a* thereon, causing the lock block 49*a* to move forwardly along the tightening bolt 48, pinching the transverse portion 47*b* of the mount bracket 47 between the lock block 49*a* and the head portion of the tightening bolt 48, thereby preventing counter-clockwise rotation of the tightening bolt 48 (and the latch 49*b*) without applying a substantially large counter-clockwise torque thereto. Because the head portion of the tightening bolt 48 is spaced rearwardly from the key hole 44, counter-clockwise rotation of the latch 49*b* from the "locked" position is prevented without a key.

The latch 49*b* is moveable into the "unlocked" position by applying sufficient counter-clockwise torque to the tightening bolt 48 to relieve the frictional pinch of the transverse portion 47*b* of the mount bracket 47 between the lock block 49*a* and the head portion of the tightening bolt 48. Once sufficient counter-clockwise torque is applied, the latch 49*b* rotates in a counter-clockwise direction due to the tight threaded fit between the tightening bolt 48 and the lock block 49*a*, until a second side edge of the latch 49*b* abuts the upwardly-facing edge of the aperture 24, at which point the latch 49*b* is clear of the latch stop 25 and may be forwardly removed from within the aperture 24 by pivoting the door assembly 40 into the "open" position.

Because the door assembly 40 permits only enough access to the filter-receiving region 62 to receive a filter 60 therein, access to the air duct by an individual of even very small proportions is prevented. Accordingly, even if an individual successfully unlocks the security vent 10 and opens the door assembly 40, gaining access to the filter-receiving region 62 therein, escape from the enclosed region therethrough is prevented.

The security vent 10 may be provided in numerous sizes, and in a number of preselected "standard" sizes which best fit existing air vents having varying sizes. That is, the security vent 10 may be slightly "oversized" with respect to an existing air vent to which the security vent 10 is desired to be attached, in that the mounting frame 22 simply fits over the face of an existing metal plate. Accordingly, the security vent 10 according to the present invention is readily mountable to numerous existing air vents heretofore provided in secure, as well as in non-secure, facilities.

Although the present invention has been described in terms of specific embodiments set forth in detail, it should be understood that this is by illustration only and that the present invention is not limited thereto, since alternative embodiments not described herein will become apparent to those skilled in the art in view of the disclosure. Accordingly, modifications are contemplated which can be made without departing from either the spirit or the scope of the present invention as described herein.

We claim:

1. A security vent, comprising:

a housing assembly, said housing assembly including a mounting frame and a housing wall having at least one side wall portion connecting said housing wall to said mounting frame, said mounting frame having an opening therethrough, said at least one side wall portion defining an open side thereof, said housing wall having a front face portion thereof being in spaced relation to said mounting frame and cooperating with said at least one side wall portion to define a filter-receiving region therebetween, said housing wall front face having at least one opening therethrough;

a door hingedly attached to said open side of said housing wall, said door being moveable between an open position and a closed position, wherein said filter-receiving region is in communication with a region exterior to said housing wall when said door is in said open position; and, a latch assembly mounted to said door, said latch assembly being moveable between a locked position and an unlocked position, said latch assembly being received by a latch-receiving aperture provided in said mounting frame when said door is in said closed position.

2. The security vent of claim 1, said latch assembly including:

a mount bracket having a longitudinal portion attached to said door and a transverse portion having a bore therethrough;

a lock block having a threaded hole therethrough;

a latch fixedly attached to said lock block, said latch having a bore therethrough, said latch bore being coaxial with said lock block threaded hole, said lock block and said latch defining a latch weldment;

a tightening bolt having a head portion and a threaded rod portion, said tightening bolt threaded rod portion being slidingly received by said mount bracket transverse portion bore, said latch weldment being threadingly affixed to said tightening bolt threaded rod portion, said mount bracket transverse portion being disposed between said tightening bolt head portion and said latch weldment; and, wherein rotation of said tightening screw integrally rotates said latch weldment between said locked position and said unlocked position.

3. The security vent of claim 1, said latch-receiving aperture having a latch stop projecting over a portion thereof.

4. The security vent of claim 2, said latch-receiving aperture having a latch stop projecting over a portion thereof.

5. The security vent of claim 4, said latch being disposed behind said latch stop when said latch assembly is in said locked position.

6. The security vent of claim 1, said door having a key hole therethrough, said key hole being coaxial with said latch assembly.

7. The security vent of claim 2, said door having a key hole therethrough, said key hole being coaxial with said latch assembly.

8. The security vent of claim 7, said tightening bolt head portion including a recess therein, said recess having a plurality of side walls, said recess being sized to receive a key therein through said key hole to move said latch assembly between said locked position and said unlocked position.

9. The security vent of claim 1, further comprising:

a filter removably inserted into said filter-receiving region.

10. The security vent of claim 9, said filter is constructed from fiberglass.

11. The security vent of claim 1, wherein said door is flush with said housing wall when said door is in said closed position.

12. The security vent of claim 1, wherein said mounting frame is affixed to an inlet end of an air duct, said air duct being in flow communication through said security vent.

13. The security vent of claim 1, wherein said mounting frame is affixed to an outlet end of an air duct, said air duct being in flow communication with said security vent.

14. The security vent of claim 1, said door being connected to said housing wall by a continuous hinge.

* * * * *